United States Patent [19]

Kayanuma

[11] Patent Number: 5,056,494

[45] Date of Patent: Oct. 15, 1991

[54] SYSTEM FOR TREATING VAPORIZED FUEL IN AN INTERNAL COMBUSTION ENGINE

[75] Inventor: Nobuaki Kayanuma, Gotenba, Japan

[73] Assignee: Toyota Jidosha Kabushiki Kaisha, Aichi, Japan

[21] Appl. No.: 512,452

[22] Filed: Apr. 23, 1990

[30] Foreign Application Priority Data

Apr. 26, 1989 [JP] Japan ..... 1-48234[U]

[51] Int. Cl.[5] ..... F02M 33/02

[52] U.S. Cl. ..... 123/519; 123/516; 220/85 US; 137/588

[58] Field of Search ..... 123/516, 518, 519, 520, 123/521; 220/86 R, 85 UR, 85 US; 137/587, 588; 55/387

[56] References Cited

U.S. PATENT DOCUMENTS

| | | | |
|---|---|---|---|
| 2,620,822 | 12/1952 | Peterson | 137/588 |
| 3,617,034 | 11/1971 | Skinner | 123/518 |
| 3,844,264 | 10/1974 | Grainger | 123/518 |
| 3,884,204 | 5/1975 | Krautwurst et al. | 123/136 |
| 3,911,977 | 10/1975 | Berger | 220/86 R |
| 4,142,647 | 3/1979 | Walters | 220/85 US |
| 4,572,394 | 2/1986 | Tanashi | 220/85 US |
| 4,651,889 | 3/1987 | Uranishi | 123/519 |
| 4,659,346 | 4/1987 | Uranishi | 123/519 |
| 4,701,198 | 10/1987 | Uranishi | 123/519 |
| 4,817,576 | 4/1989 | Abe | 123/518 |
| 4,919,103 | 4/1990 | Ishiguro | 123/519 |

FOREIGN PATENT DOCUMENTS

| | | |
|---|---|---|
| 49-76113 | 7/1974 | Japan . |
| 55-154251 | 12/1980 | Japan . |
| 59-142460 | 9/1984 | Japan . |
| 59-165564 | 11/1984 | Japan . |
| 61-141129 | 9/1986 | Japan . |
| 63-14858 | 1/1988 | Japan . |
| 55-161952 | 12/1990 | Japan . |

OTHER PUBLICATIONS

Review of Toyota published Technology No. 23, Jul. 29, 1987.

*Primary Examiner*—Carl Stuart Miller
*Attorney, Agent, or Firm*—Kenyon & Kenyon

[57] ABSTRACT

A device for treating vaporized fuel from a fuel tank of an internal combustion engine, and having a canister. The fuel tank has an inner partition wall which divides the space inside the fuel tank into a first small chamber and a second large chamber, which are separated from each other. A fuel flow is allowed at locations below the fuel levels in the first and second chambers, which are independently connected to the canister device, and a fuel filling pipe is open to the first, small chamber. A pressure control means is provided for maintaining a pressure in the second chamber higher than that in the first chamber, which is near to the atmospheric pressure, whereby fuel vapor is prevented from escaping from the first chamber during a fuel-filling operation.

9 Claims, 2 Drawing Sheets

SYSTEM FOR TREATING VAPORIZED FUEL IN AN INTERNAL COMBUSTION ENGINE

BACKGROUND OF THE INVENTION

1. Field of the Invention

The present invention relates to a device for treating vaporized fuel generated in a fuel supply system of an internal combustion engine not only when the fuel supply system is being filled with fuel but also when such a fuel filling operation is not underway.

2. Description of the Related Art

It is well known to temporarily hold an amount of vaporized fuel in an internal combustion engine, in a canister provided with an activated charcoal layer therein, and to later re-introduce the vaporized fuel into the engine. In a known device, fuel vapor from a fuel tank can be captured by the canister while the filler cap covers the fuel inlet to the fuel tank, i.e., a fuel filling operation is not being carried out, and to obtain a predetermined positive pressure in the fuel tank, the canister is provided with a check valve. This known canister system cannot prevent fuel vapor from being exhausted to the atmosphere when the filler cap is removed, and therefore, it is necessary to provide a method of preventing the vaporized fuel from being exhausted to the atmosphere when the filler cap is removed to enable a fuel filling operation to be carried out.

Accordingly, a system has been proposed wherein two canisters are provided, and these canisters are switched by a switching means so that one of the canisters is used for holding vaporized fuel generated when the filler cap is removed, i.e., when a fuel filling operation is carried out, and the other canister is used for holding vaporized fuel generated when the filler cap is attached, i.e., a fuel filling operation is not being carried out. (See Japanese Unexamined Utility Model Publication No. 59-14460 and Japanese Unexamined Utility Model Publication No. 61-141129.)

In such a device provided with a pair of canisters, the provision of an inlet pipe of a fuel tank, which extends downward to a point adjacent to the bottom inner surface of the fuel tank, has been proposed to prevent a direct impingement of incoming fuel on the fuel in the fuel tank during the fuel filling operation; as this would produce bubbles in the fuel and these bubbles exhausted to the outside atmosphere. The downwardly elongated inlet tube also serves to reduce the total surface area of the fuel in the fuel tank which comes into contact with the atmospheric air.

Such a canister device, however, can hold only a limited amount of vaporized fuel; therefore, to reduce the amount of vaporized fuel from the fuel tank, to maintain the canister device in an activated condition. Therefore, a check valve is provided to ensure a constant pressure inside the fuel tank when the filler cap covers the fuel tank inlet which allows the amount of vaporized fuel in the fuel tank to be suppressed or lowered. Nevertheless, the high pressure in the fuel tank causes a large amount of vaporized fuel to be instantly exhausted to the atmosphere when the filler cap is removed for a fuel filling operation. To obviate this difficulty, it is necessary to maintain the pressure inside the fuel tank at a lower value. This, however, causes the amount of vaporized fuel to be increased, and thus a drawback arises in that the canister must have an increased volume to cope with the increased amount of vaporized fuel.

SUMMARY OF THE INVENTION

An object of the present invention is to provide a device capable of overcoming the above difficulty.

Another object of the present invention is to provide a device capable of obtaining a predetermined positive pressure in the fuel tank such that a discharge of the vaporized fuel from the fuel tank to the atmosphere is prevented when a filler cap of the fuel tank is removed for a fuel filling operation.

Therefore, according to the present invention, an internal combustion engine is provided which comprises an engine body; a fuel tank; an intake system connected to the engine body and having a throttle valve therein; canister means for temporarily holding fuel vapor from the fuel tank; means for reintroducing the fuel vapor held in the canister means into the intake system; partition means arranged in said fuel tank and forming therein a first small volume chamber and a second large volume chamber, respectively.

The first and second chambers are seperated from each other in such a manner that a flow of vaporized fuel therebetween is prevented while allowing a communication of liquid fuel between locations in the fuel tank below the fuel levels in the first and second chambers. The fuel tank also has a fuel filling pipe and a cap detachably connected to the fuel filling pipe, the filling pipe being opened to the first chamber at a position above the fuel level in the chamber. Further, the fuel tank has first conduit means for allowing a flow of vaporized fuel between the first chamber and the canister while ensuring a positive valve pressure near the atmospheric pressure, in the first chamber, and second conduit means for allowing a flow of vaporized fuel between the second chamber and the canister. Finally, the fuel tank has pressure control means provided in said second conduit means for ensuring a postitive value of a pressure in the second chamber higher than the pressure in the first chamber.

DESCRIPTION OF THE PREFERRED EMBODIMENTS

Figure 1:
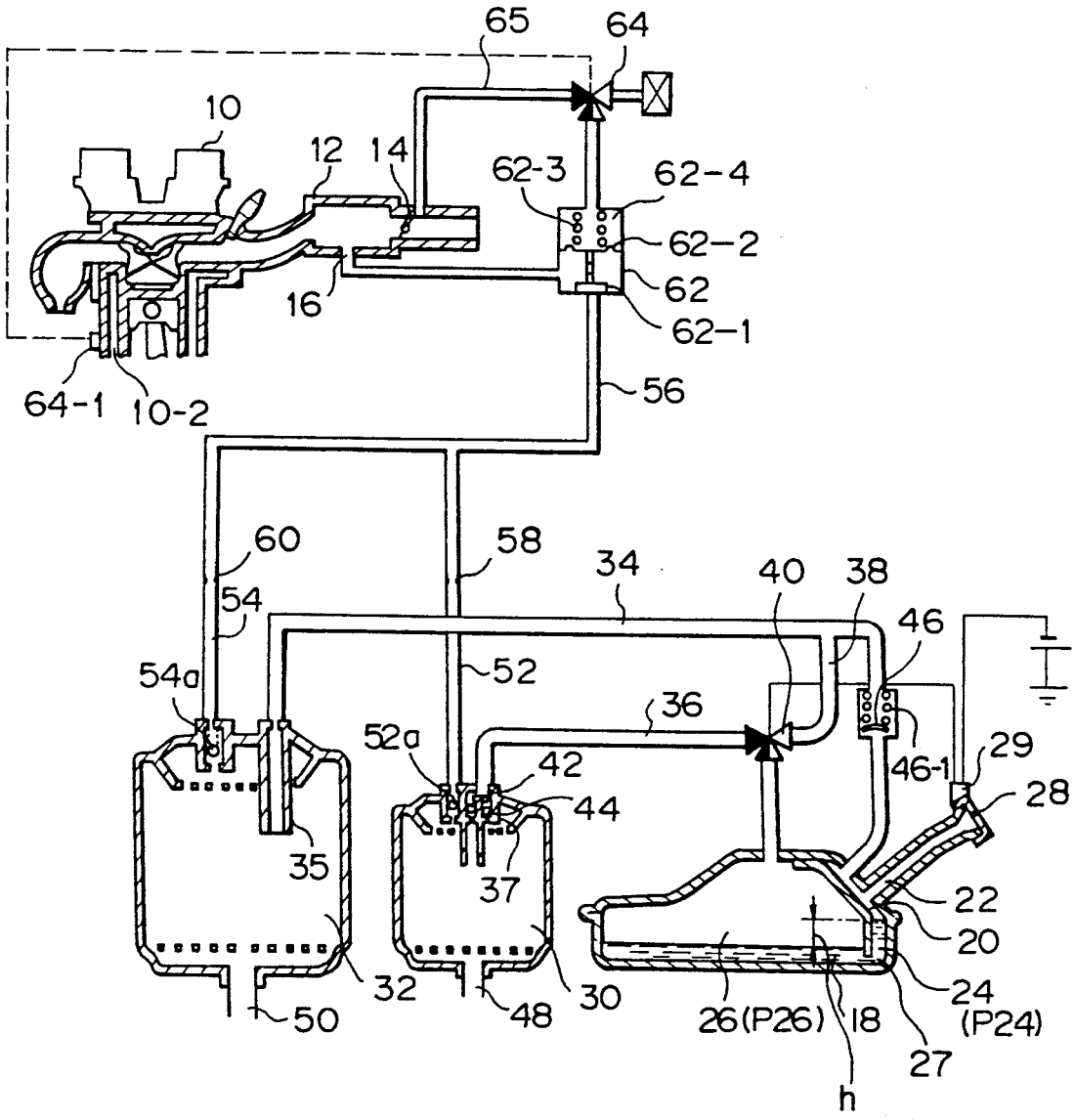
FIG. 1 is a general view of the device of the first embodiment of the present invention.

Referring to FIG. 1, reference numeral 10 denotes an internal combustion engine, 12 an intake passageway connected to the engine 10, and 14 is a throttle valve arranged in the intake passageway 12. The intake passageway 12 is provided with a purge port 16, which is opened to the intake passageway 12 at a position downstream of the throttle valve 14 when it is opened from its idle position. Therefore introduction of the fuel from the canister is commenced after the throttle valve is opened from the idling position.

Reference numeral 18 is a fuel tank provided with a partition wall 20 which divides the space in the tank 18 into two chambers, i.e., a first chamber 24 provided with a fuel filling pipe 22 and a second chamber 26 not provided with a fuel filling pipe. The partition wall 20 is fixed at one end to the upper inner wall of the tank 18 and extends near to the bottom, to thus provide a passageway 27 which allows the first and second chambers 24 and 26 to communicate with each other at the bottom of the tank 18. The filling pipe 22 extends from the outer wall of the tank 18 to a position above the upper portion of the tank 18, to define an open end to which a filler cap 28 is mounted. It should be noted that the area of a fuel surface in the first chamber 24 is much smaller than that of the second chamber 26.

In the embodiment shown in FIG. 1, a small canister 30 for the vaporized fuel and a large canister 32 for reintroducing the vaporized fuel are provided. The large canister 32 has a much bigger volume than the small canister 30. A first conduit 34 connects the first chamber 24 of the fuel tank 18 with the large volume vapor recovery canister 32 via a union 35, and a second conduit 36 connects the second chamber 26 with the small canister 30 via a union 37. Furthermore, a third conduit 38 connects the first conduit 34 and the second conduit 36. An electromagnetic switching valve 40 is arranged at a point at which the second conduit 36 and the third conduit 38 are connected with each other, so that the second chamber 26 of the fuel tank 18 can be selectively connected between the small canister 30 and the large canister 32. A switch 29 is provided for detecting whether the filler cap is removed, for switching the electro-magnetic switching valve 40 in such a manner that the second chamber 26 of the fuel tank 18 is connected to the small canister 30 when the filler cap 28 is attached, i.e., a fuel filling operation is not underway, and the second chamber 26 of the tank 18 is connected to the large canister 32 when the filler cap 28 is removed.

Figure 2:
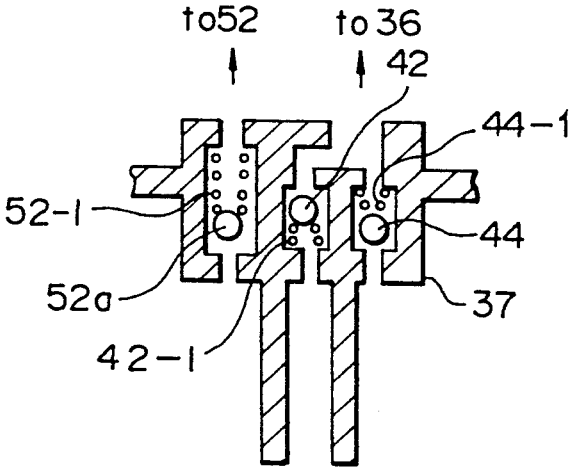
FIG. 2 is an enlarged view of a part of FIG. 1.

As shown in more detail in FIG. 2, the small canister 30 is provided with a first ballshaped check valve 42 at one end of the passageway 36. This check valve 42 is opened when the pressure of the vaporized fuel in the second chamber 26 of the fuel tank 18 is higher than a predetermined value, to allow the vaporized fuel to be absorbed by the canister 30. A second check valve 44 is also arranged at the end of the passageway 36 in parallel with the first check valve 44 but directed in the opposite direction. This second check valve 42 is opened against the force of a spring 44-1, to allow a flow of fluid from the canister 30 to the fuel tank 18 when a vacuum pressure in the fuel tank 18 is larger than a predetermined value, to prevent the occurrence of an excessive vacuum pressure in the space inside the fuel tank 18. As shown in FIG. 1, a third check valve 46 is arranged in the first conduit 34, and allows a flow of vaporized fuel from the first chamber 24 of the fuel tank 18 to a large canister 32. A set pressure of a spring 46-1 of the third check valve 46 is lower than the set pressure of a spring 42-1 of the first check valve 42, and thus the pressure of the first chamber 24 of the fuel tank 18 is controlled to a pressure near the atmospheric pressure. The small canister 30 is provided at the bottom end wall thereof with an air introduction pipe 48, to allow purging air to be introduced into the first canister 30, and is provided at the upper end wall thereof with a purge pipe 52, for re-introducing the vaporized fuel in the canister 30 into the internal combustion engine. A check valve **52*a* is arranged in the purge pipe 52 and opens to allow the vaporized fuel to flow from the canister 30 to the engine intake passageway, against the force of the spring 52-1. The large canister 32 is provided at the bottom end wall thereof with an air introduction pipe 50, for introducing purging air into the canister 32, and at the upper end wall thereof with a purge pipe 54 for re-introducing the vaporized fuel in the large canister 32 into the intake passageway 12 of the internal combustion engine. A check valve 54*a* is arranged in the purge pipe 54 and allows the vaporized fuel to flow from the canister 32 to the engine intake passageway 12, in the same way as the check valve 52*a*. The purge pipes 52 and 54 from the small and large canisters 30 and 32, respectively, are connected to one end of a pipe 56. The other end of the pipe 56 is connected to the intake passageway 12 of the engine at position downstream of the throttle valve 14. A vacuum operated purge control valve 62 is arranged in the passageway 56, and is provided with a valve member 62-1, a diaphragm 62-2 connected to the valve member 62-1, and a spring 62-3 urging the valve member 62-1 to a normally closed position to prevent an introduction of vaporized fuel from the canisters 30 and 32 into the engine. A temperature sensitive (thermo) valve 64 is arranged in a vacuum passageway 65 connecting the diaphragm 62-2 to the intake passageway 12, at a position upstream of the throttle valve 14. The thermo valve 64 is connected to a temperature sensor member 64-1, such as a thermowax, mounted on a portion of the engine 10 and in contact with the engine cooling water in a water jacket 10-2. The valve 64 disconnects the diaphragm 62-2 from the intake pipe 12 to close the valve member 62-1 and prevent an introduction of fuel from the canisters 30 and 32, when the temperature sensed by the thermowax 64-1 is lower than a predetermined value, and connects the diaphragm 62-2 to the intake pipe, to allow an introduction of a vacuum from the intake pipe 12, and thereby allow the valve member 62-1 to be opened for an introduction of vaporized fuel from the canisters 30 and 32 into the engine, when the temperature sensed by the thermowax 64-1 is higher than the predetermined value. Namely, as easily understood from the above description, the purge control valve 62 is opened when the temperature of the engine water is higher than the predetermined value, and when a predetermined level of vacuum is created in the diaphragm chamber 62-4**.

The operation of the first embodiment in FIG. 1 will now be described. When a filling operation is not carried out and the filler cap 28 is thus closing the filling pipe 22, the electro-magnetic valve 40 assumes a position at which the second chamber 26 of the fuel tank 18 is connected to the small canister 30, so that the pressure of the vaporized fuel in the chamber 26 becomes higher than a predetermined value P26, and thus the check valve 42 is opened against the force of the spring 42-1. As a result, the vaporized fuel in the chamber 26 is introduced into the small canister 30 while the pressure of the chamber 26 is maintained at this predetermined value P26. The pressure of the vaporized fuel in the first chamber 24 of the fuel tank 18 is lower than that in the second chamber 26. It should be noted that the area of the fuel surface in the first chamber 24 is smaller that of the second chamber 26. If the pressure of the vaporized fuel in the chamber 24 becomes higher than a predetermined value P24, the check valve 46 is opened against the force of the spring 46-1. This predetermined value P24 in the first chamber 24 is near to the atmospheric pressure and is, of course, smaller than the predetermined value P26 in the second chamber 26. As a result, the vaporized fuel in the chamber 24 is introduced into the large canister 30 while the pressure of the chamber 24 is maintained at this predetermined value P24. It should be noted that a difference h of the height of the fuel levels in the first and second chambers is created, as shown in FIG. 1, because the pressure in the first chamber 24 is lower that in the second chamber 26.

When the filling cap 28 is removed from the filling pipe 22, to carry out a fuel filling operation, the fuel vapor in the fuel tank 18 is prevented from escaping to the atmosphere because the first chamber 24 opened to the fuel filling pipe 22 is maintained at a pressure P24 near to the atmospheric pressure. The vaporized fuel in the second chamber 26 is prevented from escaping to the atmosphere because the second chamber 26 is disconnected from the first chamber 24 by the partition wall 20, which extends downwardly from the upper inner wall of the fuel tank 19 so that the bottom end thereof is located below the fuel level in the second chamber 26.

The removal of the filling cap causes the switch 29 to operate the electro-magnetic switching valve 40 so that it is switched from the OFF position at which the second chamber 26 is connected to the small canister 30 to the ON position at which the second chamber 26 is connected to the large canister 32. Furthermore, the fuel filling pipe 22 is sealed to the atmosphere by a fuel filling nozzle inserted therein by an operator. As a result, the vaporized fuel generated during the fuel-filling operation can be recovered and held by the large volume canister 32. During this fuel-filling operation, the check valve 46 prevents a flow of the vaporized fuel in the second chamber 26 back to the first chamber 24.

When the filling cap 28 is attached to and closes the filling pipe 22, after the completion of the fuel-filling operation, the filling cap sensor 29 outputs a signal by which the electro-magnetic valve 40 is made OFF and moves to a position at which the second chamber 26 is again connected to the small low volume canister 30. Namely, the fuel vaporized from the second chamber 26 is sent to the small canister 30 when the fuel filling operation is not being carried out. Furthermore, the check valve 46 prevents a flow of the fuel held in the large canister 32 back to the first chamber 24 of the fuel tank 18. The greater part of the vaporized fuel held in the large canister 32, temporarily generated during the preceding fuel-filling operation, is introduced into the engine intake passageway 12 via the purge pipe 54 and 56, at a controlled rate, during the engine operation. Contrary to this, the vaporized fuel continuously generated in the second chamber 26 of the fuel tank during a normal running of the engine, is held in the small canister 30 and simultaneously introduced into the engine.

As will be seen from the above, the first embodiment is provided with a small low volume canister 30 connected to the high pressure portion of the fuel tank for vaporized fuel when a fuel-filling operation is not being carried out, and a large high volume canister 32 connected to the low pressure portion of the fuel tank for vaporized fuel during the fuel-filling operation. As a result, an increased inner pressure of the fuel tank and reduced inner pressure of the fuel-filling port, which are contradictory requirements, are obtained simultaneously, and thus an effective recovery of the vaporized fuel from the fuel tank is realized throughout the various modes of operation of the engine.

Figure 3:
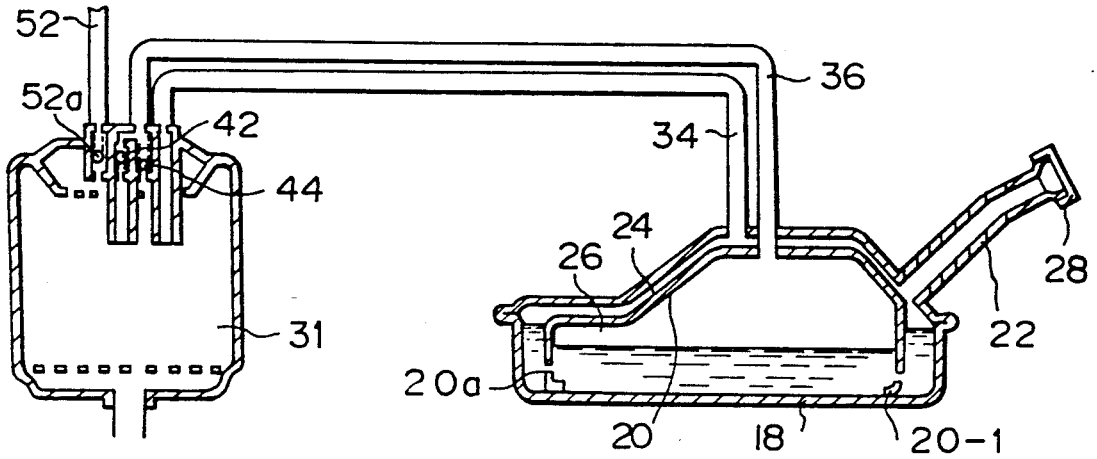
FIG. 3 is a partial view of a second embodiment.

FIG. 3 shows a second embodiment wherein only one canister 31 is provided. The fuel tank 18 is provided therein with a partition wall 20 which is usually located adjacent to and spaced from the inner wall of the tank 18, to provide a double wall structure by which a first outside chamber 24 and a second inside chamber 26 are created inside the fuel tank 18. The partition wall 20 has a bottom flanged end 20-1 fixedly connected to the bottom inner wall of the tank 18. Openings **20*a* are provided adjacent to the bottom end of the partition wall 20, and connect the first and second chambers 24 and 26 with each other. A lower end of fuel-filling pipe 22 is connected to the upper portion of the fuel tank 18 and opens into the first chamber 24. The first chamber 24 is connected to the canister via a conduit 34 which is not provided with a valve such as the check valve 46 in the first embodiment. The second chamber 26 is connected to the canister 31 via a conduit 36 and is provided with a check valve 42 for maintaining a predetermined pressure P26 inside the second chamber 26 and a check valve 44 for preventing a vacuum pressure in the fuel tank, as in the first embodiment. In this embodiment, the electro-magnetic switching valve 40 of the first embodiment is omitted and the vaporized fuel from the first and second chambers 24 and 26 on the fuel tank 18 is introduced into a common canister 31. As is easily understood, the first chamber 24 is always under an atmospheric pressure, and therefore, the removal of the filler cap 28 does not allow an escape of the vaporized fuel from the fuel filling pipe 22** into the atmosphere.

Figure 4:
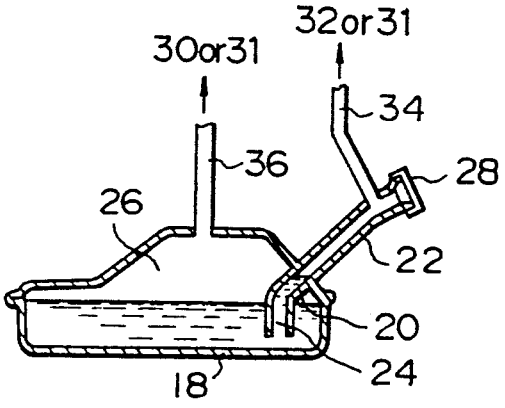
FIGS. 4 and 5 are partial views of third and fourth embodiments of the present embodiment.

In a third embodiment shown in FIG. 4, a partition wall 22 is constructed by a lower part of the filling pipe 20, which is extended inwardly of the fuel tank 18 in such a manner that the lower end of the wall 20 is located below the level of the fuel in the fuel tank 18. The first conduit 34 from second canister 32 is provided as shown in the first embodiment in FIG. 1, or from the canister 31 as shown in the second embodiment in FIG. 2. The second conduit 36 from the small canister 30 is provided as shown in the first embodiment in FIG. 1, or from the canister 31 as shown in the second embodiment in FIG. 2. In this embodiment, it is possible to maintain the pressure P24 in the first chamber 24 at nearly the atmospheric pressure, which is lower than the pressure P26 in the second chamber 26 maintained at a predetermined value by the check valve 42 as shown in FIG. 1 or 2.

Figure 5:
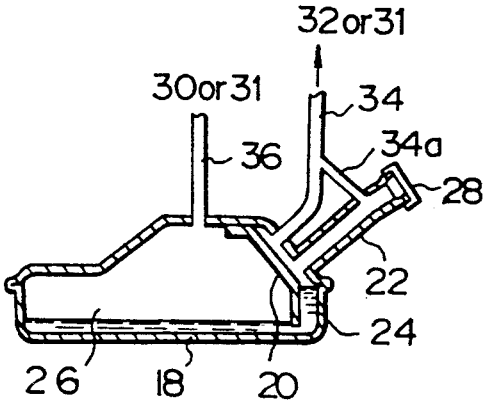

FIG. 5 shows another embodiment wherein the first conduit 34 is not only connected to the upper part of the first chamber 24 in the fuel tank 18 but also to the fuel filling pipe 22, via a branched pipe **34*a*. In this embodiment, it is also possible to obtain a predetermined positive value pressure P26 in the large chamber 26 and to obtain a pressure P24 in the first chamber 24** near to the atmospheric pressure.

I claim:

1. An internal combustion engine, comprising:

an engine body;

a fuel tank;

an intake system connected to the engine body and having a throttle valve therein;

canister means for temporarily holding fuel vaporized from the fuel tank;

means for reintroducing the fuel vapor held in the canister means into the intake system;

partition means arranged in said fuel tank for forming therein a first small volume chamber and a second large volume chamber, respectively, said first and second chambers being separated from each other in such a manner that a communication of vaporized fuel therebetween is prevented while allowing a communication of liquid fuel between locations in the fuel tank below the fuel levels in the first and second chambers;

said fuel tank having a fuel filling pipe and a filler cap detachably connected to the filling pipe, said filling pipe being opened to the first chamber at a position above the fuel level therein;

first conduit means for allowing a flow of vaporized fuel between the first chamber and the canister means while maintaining a positive value pressure in the first chamber near the atmospheric pressure;

second conduit means for allowing a flow of vaporized fuel between the second chamber and the canister means; and pressure control means provided in said second conduit means for obtaining a positive value pressure in the second chamber larger than that in the first chamber.

2. A device according to claim 1, wherein said canister means comprise a first canister and a second canister, which are separate from each other, the first canister being connected to the first chamber via the first conduit means and the second canister being connected to the second chamber via said second conduit means.

3. A device according to claim 2, further comprising a third conduit means for connecting said first conduit and said second conduit with each other, valve means provided in the third conduit for switching between a first condition wherein the second chamber is connected to the second canister and a second position wherein the second chamber is connected to the first canister, means responsive to a position of said filler cap for energizing the switching means to switch from the first condition to the second condition when the filling cap is removed from the filling up pipe, and one way valve means arranged in said first conduit means with respect to of the third conduit near the first chamber.

4. A device according to claim 2, wherein said first canister has a volume which is smaller than that of the second canister.

5. A device according to claim 1, wherein said partition means comprise a partition wall in the fuel tank, said partition wall having an upper end connected to the fuel tank at an inner, upper surface in a cantilever fashion, so that a space is formed between the bottom end of the partition wall and the inner, bottom wall of the fuel tank to allow said flow of fuel.

6. A device according to claim 5, wherein said partition wall has a tubular shape and is an integral elongated part of the filling pipe.

7. A device according to claim 1, wherein said partition means comprise a partition wall in the fuel tank, said partition wall being arranged inside the fuel tank along the entire inner periphery except for an inner, bottom wall so that said first and second chambers are formed outside and inside the partition wall, respectively, said partition wall having a peripheral edge portion connected to the inner, bottom wall of the tank, and having at least one opening at a position near the edge portion, to allow said flow of fuel.

8. A device according to claim 1, further comprising an auxiliary passageway for connecting said first conduit means to the fuel filling pipe at a position near the filling cap.

9. A device according to claim 1, further comprising means responsive to the temperature of the engine for allowing the fuel introduction from the canister means at a predetermined temperature range of the engine.

* * * * *

UNITED STATES PATENT AND TRADEMARK OFFICE

CERTIFICATE OF CORRECTION

PATENT NO. : 5,056,494

DATED : October 15, 1991

INVENTOR(S) : Nobuaki Kayanuma

It is certified that error appears in the above-identified patent and that said Letters Patent is hereby corrected as shown below:

| Column | Line | |
|---|---|---|
| 1 | 55 | After "vaporized fuel" insert --exhausted--; After "fuel tank" insert --it is preferred--. |
| 2 | 37 | Change "valve" to --value--. |
| 3 | 48 | Change "valve 44" to --valve 42--. |
| 3 | 50 | Change "valve 42" to --valve 44--. |
| 4 | 17 | Before "position" insert --a--. |
| 4 | 49 | After "not" insert --being--. |
| 4 | 63 | After "smaller" insert --than--. |
| 5 | 9 | Change "that" to --than--. |
| 8 | 1 | Change "filling up pipe" to --filling pipe--. |
| 8 | 3 | After "with respect to" delete "of". |

Signed and Sealed this

Eighteenth Day of May, 1993

*Attest:*

Michael K. Kirk

MICHAEL K. KIRK

*Attesting Officer*

*Acting Commissioner of Patents and Trademarks*